US005116038A

United States Patent [19]

Kim

[11] Patent Number: 5,116,038

[45] Date of Patent: May 26, 1992

[54] PAPER FEEDING APPARATUS

[75] Inventor: Hyoung-Chae Kim, Ahnyang, Rep. of Korea

[73] Assignee: SamSung Electronics Co., Ltd., Kyung, Rep. of Korea

[21] Appl. No.: 559,055

[22] Filed: Jul. 30, 1990

[30] Foreign Application Priority Data

Nov. 25, 1989 [KR] Rep. of Korea ..... 17201/1989

[51] Int. Cl.[5] ..... B65H 3/06

[52] U.S. Cl. ..... 271/10; 271/116; 271/270

[58] Field of Search ..... 271/116, 270, 10

[56] References Cited

U.S. PATENT DOCUMENTS 4,522,385 6/1985 Stefansson ..... 271/116 X
4,865,305 9/1989 Momiyama ..... 271/116

FOREIGN PATENT DOCUMENTS 61242 5/1981 Japan ..... 271/116
257839 11/1986 Japan ..... 271/116

*Primary Examiner*—Richard A. Schacher
*Attorney, Agent, or Firm*—Robert E. Bushnell

[57] ABSTRACT

A paper feeding device for a facsimile machine, photocopier or the like is provided. The device includes a feed roller rotatably mounted on an axle which is supported by a frame. The axle is attached by a bushing and a spring clutch to a paper feeding gear which is driven by a suitable device or motor. The feed roller includes a sleeve arranged to co-operate, via a groove, with a spring pin fixed to the axle so as to provide a lost-motion mechanism between the shaft and the sleeve. A gear is arranged to drive a transfer roller faster than the gear drives the axle. In use, when paper is present between rollers, the pin is at one end of the groove. After a sheet of paper has been fed from the feed roller to the transfer roller, the feed roller will stop and not be driven by the gear until the spring pin of the lost motion mechanism has rotated from one end of the groove to the other end. The provision of such a lost motion mechanism may allow successive sheets of paper fed through the apparatus to be spaced apart at a predetermined distance.

10 Claims, 2 Drawing Sheets

PAPER FEEDING APPARATUS

BACKGROUND OF THE INVENTION

1. Field of the Invention

The present invention relates to a paper feeding apparatus. Particularly, although not exclusively, the apparatus is designed to automatically and accurately feed papers one by one at generally regular intervals into a paper receiving apparatus, for example, a facsimile machine or a photocopier.

2. Description of the Background Art

In a conventional facsimile machine, sheets of paper are fed in consecutive order, from a paper feeding tray into the machine which then scans each sheet in turn to generate a transmission signal which is transmitted to a location identified by a user.

A known device for feeding the papers into a facsimile machine is illustrated in FIG. 1 of the accompanying drawings which is a front view of part of a paper feeding apparatus, and FIG. 2 which is a perspective view showing essential parts of the apparatus of FIG. 1 separated.

In the Figures a paper feeding roller 1, for separately feeding respective sheets of paper loaded on a paper feeding tray (not shown) is supported by a frame 3. A spring clutch 5, supported in part by a bushing 4, is provided to connect or cut torque which is delivered from an outside power source, for example, a motor (not shown). A paper feeding gear 6 delivers the torque to an axle 2 of the paper feeding roller 1.

The spring clutch 5 is engaged with the cylindrical part of paper feeding gear 6 and the cylindrical part of bushing 4 in a rotatable direction. A transfer roller 7 which is positioned parallel to the paper feeding roller 1 to transfer the respective papers is also supported by the frame 3. A pinch roller 12, arranged to co-operate with the transfer roller 7, is supported in another frame (not shown). A transfer gear 8 is fixed to an end of the transfer roller 7 and receives torque delivered from the outside, and in turn delivers the torque to the transfer roller 7. When the respective papers 9 are fed to the paper feeding roller 1 from the paper feeding tray, the paper feeding gear 6, having received power from the outside, drives the paper feeding roller 1 in the direction indicated by arrow "A" via the spring clutch 5 and the bushing 4.

As the transfer roller 7 turns faster than the paper feeding roller 1, when the paper 9 is fed from the paper feeding tray by the rotation of the transfer roller 7, the paper is under tension due to the difference in speed between the two rollers 1 and 7. Thus, a phase progress difference $\Delta\Theta$ between the bushing 4, the transfer roller 7 and the paper feeding gear 6 occurs. As an outer end **5*b* of the spring clutch 5 is inserted into a notch part 6*b* of the paper feeding gear sleeve 6*a*, and at the same time, an inner end of the spring clutch 5*a* is laid across the notch part 4*a* of the bushing 4, rotation of the bushing 4 in the direction indicated by arrow "A" enables the spring clutch 5 to loosen, and some degree of the torque is absorbed and accumulated in the spring clutch 5. The phase progress difference progresses properly according to the length of the paper by means of composition of the outer end 5*b* of the spring clutch inserted into the notch part 6*b* of paper feeding gear 6 for the paper feeding roller 1. The phase progress difference $\Delta\Theta$ remains until the rear end of the paper leaves the paper feeding roller 1 and a succeeding paper is fed onto the paper feeding roller 1**.

Consequently, the conventional paper feeding device torque is accumulated in the spring clutch 5, since the spring clutch 5, which controls the revolution of the paper feeding roller 1, is loosened to the extent of the phase progress difference $\Delta\Theta$, due to a difference in speed of revolution between the bushing 4 provided over the axle 2 of the paper feeding roller 1, and the paper feeding gear 6. The accumulated torque debars the paper feeding roller 1 from rotating at the same speed as the speed of the transfer roller 7. The longer the sheet of paper 9, the more serious the debarment. Therefore, there is a problem with the conventional paper feeding device in that it is difficult to maintain an interval between the papers that permits a sensor which senses a succeeding paper because if the interval between the papers is too narrow.

SUMMARY OF THE INVENTION

An object of the present invention is to ameliorate problems with known apparatus, as described above.

According to one aspect of the invention, there is provided a paper feeding device for a facsimile machine, photocopier or the like, comprising, a feed roller which comprises a drive axle and a sleeve thereon drivable by the drive axle; a transfer roller, arranged to receive paper from the feed roller; and lost motion means being provided between the sleeve and the axle such that the axle can be driven a distance without the sleeve being driven.

The lost motion means can include a projection and a collar defining a slot, one being respectively provided on the axle and the other being part of the sleeve or attached thereto, the projection being arranged to cooperate with the slot, the arrangement being such that it operate with the slot. The arrangement is such that when the projection abuts the collar, the sleeve can be driven by the drive axle and when the projection is within the slot but does not about the collar, the projection can be driven by the drive axle without the sleeve being driven.

Preferably, the projection is mounted on the axle and the collar is part of the sleeve or attached thereto.

According to a second aspect or embodiment of the invention, there is provided a paper feeding device for a facsimile, a copier or the like. This embodiment includes a paper feeding means arranged to be rotatable substantially at the same speed as a transfer roller and includes a spring clutch provided between a paper feeding gear and a bushing. The paper feeding roller has a sleeve and is rotatably mounted on an axle of the paper feeding roller. The sleeve has a groove at one end and the paper feeding roller is arranged to be driven by a spring pin mounted on the axle.

The sleeve may include a detent formed on one side of the sleeve and supported elastically in a notch formed in the axle of the paper feeding roller.

Preferably, the arrangement of the device is such that, in use, although a phase progress difference $\Delta\Theta$ is made in a paper feeding gear and in the axle of the paper feeding roller by loosening of the spring clutch, the loosened spring clutch is wound again the moment the phase progress difference approaches zero, and the paper feeding roller is driven by connecting the paper feeding gear and the axle of the paper feeding roller.

The invention extends to a device according to the first aspect in combination with any of the features of the device of the second aspect.

BRIEF DESCRIPTION OF THE DRAWINGS

For a better understanding of the invention and to show how the same may be carried into effect, reference will be made, by way of example, to the accompanying diagrammatic drawings, in which.

DETAILED DESCRIPTION OF THE PREFERRED EMBODIMENT

Figure 1:
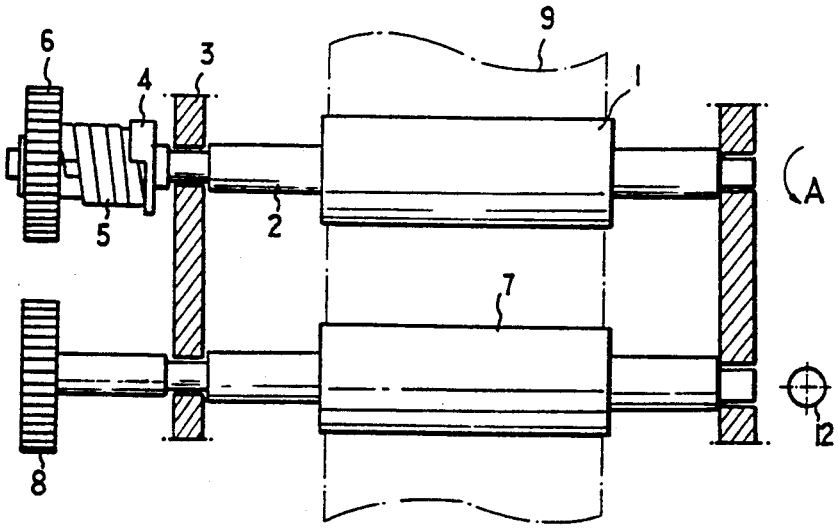
(PRIOR ART) F I G. 1
FIG. 1 is a front view illustrating part of a paper feeding apparatus.
Figure 2:
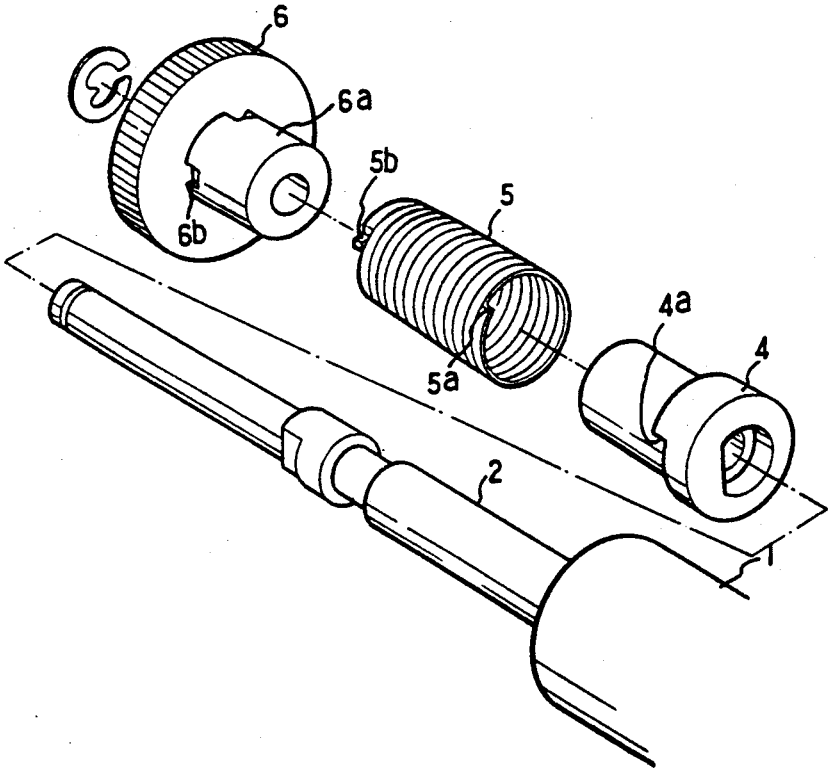
(PRIOR ART) F I G. 2
FIG. 2 is an exploded perspective view showing separate parts of the apparatus of FIG. 1.

An axle 11 of a paper feeding roller 10 which feeds papers from a paper feeding tray (not shown) is supported in a frame 3. The paper feeding roller has a sleeve 14 which is selectively rotable on the axle. One end of the paper feeding roller 10 is elastically supported by a detent 14*d* in a groove 11*a* of the axle 11 of the paper feeding roller 10, and the other end of the axle co-operates with sleeve 14, pin 13 and cut-out 30 together constituting a lost-motion mechanism. A bushing 4 is positioned over the paper feeding roller axle 11.

Figure 3A:
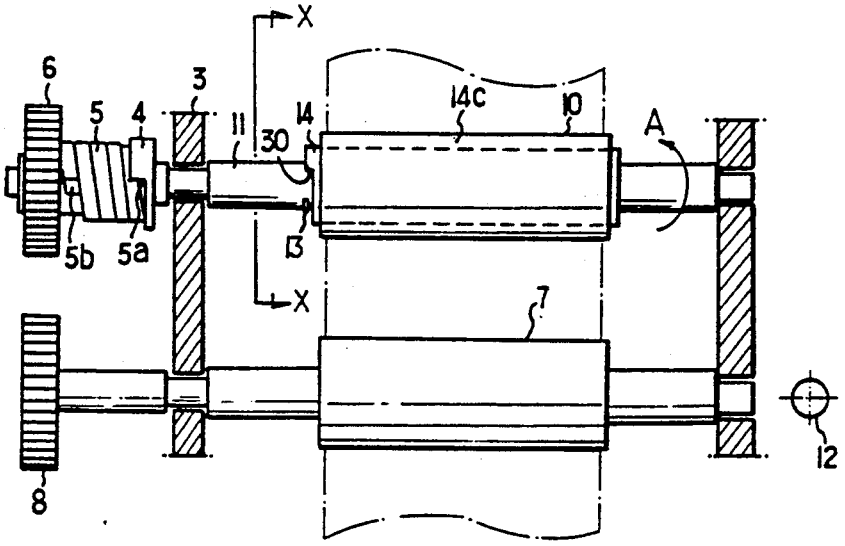
FIG. 3A is a front view of a paper feeding device.
Figure 3C:
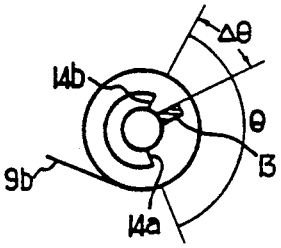
FIGS. 3B and 3C are transverse cross-sectional views of a paper feeding roller along line X—X of FIG. 1.
Figure 3B:
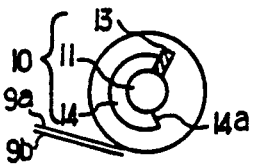

When a first paper 9*a* and a succeeding paper 9*b* are stacked on the paper feeding roller 10, the paper feeding roller 10 is rotated to provide feed thereof. At this time, the paper feeding gear 6 receives torque from, for example, a motor (not shown). When the paper feeding gear 6 turns round in the direction indicated by arrow "A", the spring clutch 5 causes the paper feeding roller 10 to rotate. The spring pin 13 fixed to the axle 11 of the paper feeding roller 10 turns at the same speed as the paper feeding gear 6. It is then caught in a notch 14*b* at one end of the cut-out 30 of the paper feeding roller sleeve 14, as seen in FIG. 3B, so that the sleeve 14 is driven and the first sheet of paper 9*a* is fed.

The paper 9*a* is fed by the paper feeding roller 10 in such a way that it becomes tensioned, because it is pulled by a faster rotating transfer rolier 7. This phenomenon occurs because the turning speed of the transfer roller 7 is faster than that of the paper feeding roller 10. That is, the transfer roller 7, the transfer gear 8 and the sleeve 14 of the paper feeding roller 10 rotate at the same speed. Moreover, the paper feeding gear 6 is coupled mechanically to the spring clutch 5, the bushing 4 as well as the axle 11 of paper feeding roller 10, all of which rotate at the same speed, but which rotate more slowly than the transfer roller 7, the transfer gear 8 and the sleeve 14 of the paper feeding roller 10. A phase progress difference $\Delta\Theta$ occurs between the axle 11 and the sleeve 14. This is due to the difference of speed between the axle 11 and the sleeve 14 and, accordingly, the spring pin 13 fixed to the axle 11 of the paper feeding roller 10, approaches catching notch 14*a*, as shown in FIG. 3C, from the catching notch 14*b*. Therefore, the phase progress difference $\Delta\Theta$ remains until the rear end of the sheet of paper 9*a* loses contact with the sleeve 14 of the paper feeding roller 10. The sleeve 14 of the paper feeding roller 10 is kept from rotating until a following paper is fed, since the paper feeding roller sleeve 14 contacts with a frictional plate which is not illustrated.

When the spring pin 13 which is formed on the axle 11 of the paper feeding roller 10 is located at the catching notch 14*b*, (FIG. 3B position) a succeeding paper 9*b* is fed due to the rotation of the sleeve 14. Rotation of the sleeve 14 stops when the paper loses contact therewith. Nevertheless, rotation of the axle 11 continues (unless a transmission is ended) and rotation of the sleeve 14 re-commences once spring pin 13 is engaged once again with catching notch 14*b*. Hence, the interval between the end of the preceding paper 9*a* and the front of the succeeding paper 9*b* is the distance corresponding to the phase progress difference $\Delta\Theta$. This distance may be wider than in the case of conventional devices.

When the length of a paper is longer than the length of standard sized paper, and a phase progress difference $\Delta\Theta$ between the axle 11 and the sleeve 14 of the paper feeding roller 10 increases, and furthermore, if the phase progress difference $\Delta\Theta$ increases to an angle $\Theta$ between the catching notches 14*a*, and 14*b* of the sleeve 14, the axle 11 and the sleeve 14 are not free to rotate separately. Accordingly, the axle 11 and the sleeve 14 of the paper feeding roller 10 will maintain the same speed, as if they are a united body.

The outer end 5*b* of the spring clutch 5 connects flexibly to the paper feeding gear 6 and the inner end 5*a* thereof is caught in the notch part 4*a* of the bushing 4. As the roller 7 is driven more quickly than the roller 10, the paper feeding gear 6 and the bushing 4 will rotate ,at different speeds. Therefore, a phase progress difference $\Delta\Theta'$ exists between the bushing 4 and the gear and, accordingly, the spring clutch 5 is let out.

Axle 11 and sleeve 14 stick fast to each other until the phase progress difference $\Delta\Theta'$ between the bushing 4 and feeding gear 6 ceases to exist and a resultant torque in the direction of arrow "A" is delivered to the bushing 4 and the axle 11 of the paper feeding roller 10 through the spring clutch 5. This will occur when the sheet of paper loses contact with roller. 10.

When a resultant torque is delivered to the bushing, through the spring clutch 5, the spring pin 13 will move from the catching notch 14*a* towards catching notch 14*b*. A subsequent sheet of paper will not be fed until the phase progress difference $\Delta\Theta$ is reduced to zero-that is, until the pin 13 reaches notch 14*b*.

In other words, when a paper of greater length than standard paper passes through the paper feeding roller 10, the maximum phase progress difference increases to $\Delta\Theta'$ plus $\Theta$ and a space from the next paper is wider compared to when a standard paper passes through the paper feeding roller 10.

Figure 4:
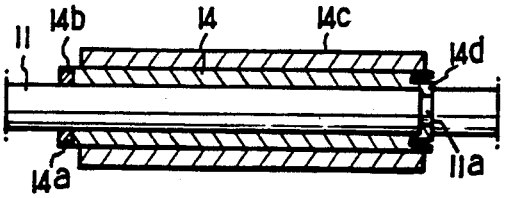
FIG. 4 is a longitudinal cross-sectional view of part of the paper feeding device.

In the embodiment shown in FIG. 4, in addition to possible functional improvements as mentioned above, it may be easy to install the paper feeding roller 10 on the frame 3. Frictional rubber 14*c* may already be formed on the sleeve 14 of the paper feeding roller 10 by being united therewith. This sleeve 14 is not allowed to move to the sleeve 14 via the rotating axle 11 of the paper feeding roller 10. The sleeve 14 of the paper feeding roller 10 is rotable within limits defined by the lost motion mechanism, in a cylindrical direction about the axle 11 of the paper feeding roller 10, but the sleeve 14 is not allowed to move from side to side. Therefore it may be convenient when the paper feeding roller 10 is installed on the frame 3. Even when the sleeve 14 of the paper feeding roller 10 is put to the axle 11 of the paper feeding roller 10, the operation of the invention is simple and easy because it uses the elasticity of detent 14*b* to advantage.

According to the present invention, the reliability of a facsimile may be improved by reason that papers are fed by spacing them uniformly and, even when a sheet of paper which is longer than the standard paper is used, the paper can be fed without excessive strain to the facsimile.

The reader's attention is directed to all papers and documents which are filed concurrently with or previous to this specification and which are open to public inspection with this specification, and the contents of all such papers and documents are incorporated herein by reference.

All of the features disclosed in this specification (including any accompanying claims, abstract and drawings), and/or all of the steps of and method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A paper feeding apparatus comprising paper feeding roller means for feeding paper and transfer roller means for receiving said paper from said paper feeding roller means, said paper feeding roller means comprising:

an axle;

a gear mounted on said axle;

a bushing mounted on said axle;

a clutch spring mounted between said gear and said bushing and on said axle;

a pin mounted on said axle;

a sleeve mounted on said axle, wherein said sleeve has a first end mounted towards said bushing and said first end includes a pair of catching notches for contacting said pin, and wherein said sleeve has a second end spaced apart from said first end and said second end includes a detent for contacting a groove in said axle; and frictional rubber means circumferentially mounted on said sleeve.

2. The apparatus as claimed in claim 1, wherein;

said gear and said pin rotate a first speed, and said sleeve is stationary until said pin contacts a first one of said pair of catching notches, whereupon said sleeve rotates said frictional rubber means for feeding said paper at said first speed when said pin contacts said first one of said pair of catching notches.

3. The apparatus as claimed in claim 2, wherein;

said transfer roller means rotates at a second speed faster than said first speed, and said sleeve rotates at said second speed when said transfer roller means receives said paper from said frictional rubber means, and said sleeve rotates at said second speed until said pin contacts a second one of said pair of catching notches or until said paper is no longer in contact with said frictional rubber means.

4. The apparatus as claimed in claim 3, wherein said sleeve remains stationary when said paper is no longer in contact with said frictional rubber means until said pin again contacts said first one of said pair of catching notches.

5. A paper feeding apparatus comprising paper feeding roller means for feeding paper and transfer roller means for receiving said paper from said paper feeding roller mans, said paper feeding roller means comprising an axle, a gear mounted on said axle, a bushing mounted on said axle, a clutch spring mounted between said gear and said bushing and surrounding said axle, and a paper feeding roller mounted on said axle, said paper feeding roller comprising:

a sleeve circumferentially mounted on said axle, wherein said sleeve has a first end mounted towards said bushing and said first end includes a pair of catching notches for contacting a pin mounted on said axle, and wherein said sleeve has a second end spaced apart form said first end and said second end includes a detent for contacting a groove in said axle; and frictional rubber means circumferentially mounted on said sleeve.

6. The apparatus as claimed in claim 5, wherein:

said gear, said axle and said pin rotate at a first speed, and said sleeve and said frictional rubber means are stationary until said pin contacts a first one of said pair of catching notches, whereupon said sleeve rotates said frictional rubber means for feeding said paper at said first speed when said pin contacts said first one of said pair of catching notches.

7. The apparatus as claimed in claim 6, wherein:

said transfer roller means rotates at a second speed faster than said first speed, and said sleeve and said frictional rubber means rotate at said second speed when said transfer roller means receives said paper from said frictional rubber mans, and said sleeve and said frictional rubber means rotate at said second speed until said pin contacts a second one of said pair of catching notches or until said paper is no longer in contact with said frictional rubber means.

8. The apparatus as claimed in claim 7, wherein said sleeve and said frictional rubber means remain stationary when said paper is no longer in contact with said frictional rubber means until said pin again contacts said first one of said pair of catching notches.

9. The apparatus as claimed in claim 8, wherein said sleeve, said frictional rubber means, said axle and said bushing rotate at said second speed when said pin contacts said second one of said pair of catching notches and said gear remains rotating at said first speed.

10. The apparatus as claimed in claim 7, wherein said sleeve, said frictional rubber means, said axle and said bushing rotate at said second speed when said pin contacts said second one of said pair of catching notches and said gear remains rotting at said first speed.

* * * * *

UNITED STATES PATENT AND TRADEMARK OFFICE

CERTIFICATE OF CORRECTION

PATENT NO. : 5,116,038

DATED : 26 May 1992

INVENTOR(S) : Hyoung-Chae KIM

It is certified that error appears in the above-identified patent and that said Letters Patent is hereby corrected as shown below:

Column 2, Line 38, replace "operate" with --operates--; and

IN THE CLAIMS

Column 5, Line 64, replace semicolon with colon.

Column 6, Line 15, replace "mans" with --means--;

Line 26, replace "form" with --from--; and

Line 45, replace "mans" with --means--.

Signed and Sealed this

Twenty-fourth Day of August, 1993

Bruce Lehman

*Attest:*

BRUCE LEHMAN

*Attesting Officer*

*Commissioner of Patents and Trademarks*